US011224777B2

(12) United States Patent
Ficner et al.

(10) Patent No.: US 11,224,777 B2
(45) Date of Patent: Jan. 18, 2022

(54) FIRE AND SMOKE ACTUATOR WITH TEMPERATURE-DEPENDENT OPERATING SPEED

(71) Applicant: Honeywell International Inc., Morris Plains, NJ (US)

(72) Inventors: Ondrej Ficner, Bucovice (CZ); Lubos Sikora, Brno (CZ); Charles Bondu, Brno (CZ)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 150 days.

(21) Appl. No.: 16/284,267

(22) Filed: Feb. 25, 2019

(65) Prior Publication Data

US 2020/0269077 A1 Aug. 27, 2020

(51) Int. Cl.
*A62C 37/36* (2006.01)
*A62C 2/24* (2006.01)

(52) U.S. Cl.
CPC ..... *A62C 37/04* (2013.01); *A62C 2/241* (2013.01); *A62C 2/247* (2013.01); *A62C 2/248* (2013.01)

(58) Field of Classification Search
CPC ..... A62C 2/241; A62C 2/247; A62C 2/248; A62C 37/04
USPC ..... 454/369
See application file for complete search history.

(56) References Cited

U.S. PATENT DOCUMENTS 5,123,081 A 6/1992 Bachman et al.
5,493,191 A 2/1996 Phoy et al.
5,519,295 A 5/1996 Jatnieks
6,249,100 B1 6/2001 Lange
7,033,268 B2 4/2006 Caliendo et al.
7,603,222 B2 10/2009 Wisemann et al.
7,922,149 B2 4/2011 Anderson et al.
8,084,982 B2 12/2011 Grabinger et al.
8,838,413 B2 9/2014 Genta
9,062,893 B2 6/2015 Romanowich et al.
9,067,091 B2 6/2015 Caliendo et al.
9,106,171 B2 8/2015 Bartholomew et al.
9,372,482 B2 6/2016 Rikkola et al.
(Continued)

FOREIGN PATENT DOCUMENTS

EP 0895346 A2 2/1999
EP 0861373 B1 8/2000

OTHER PUBLICATIONS

Driker, "Deisign Essentials: Linear Actuators with Thermo-Compensation," Machine Design, 17 pages, May 19, 2017.

*Primary Examiner* — Allen R. B. Schult
(74) *Attorney, Agent, or Firm* — Seager, Tufte & Wickhem, LLP

(57) ABSTRACT

A fire and smoke actuator includes a temperature sensor for sensing an operating temperature of the fire and smoke actuator, a drive motor, an actuator output for coupling to the damper in order to move the damper between the open position and the closed position and a drivetrain that is operably coupled between the drive motor and the actuator output. The drive motor, when activated, is configured to actuate the actuator output, via the drivetrain, to move the damper between the open position and the closed position. A drive circuit is operably coupled to the drive motor and the temperature sensor and is configured to activate the drive motor to move the damper between the open position and the closed position at a non-zero speed that is based, at least in part, on the operating temperature sensed by the temperature sensor.

13 Claims, 8 Drawing Sheets

(56) References Cited

U.S. PATENT DOCUMENTS

| | | | |
|---|---|---|---|
| 9,441,547 | B2 | 9/2016 | Cai et al. |
| 9,667,188 | B2 | 5/2017 | Kaestle et al. |
| 9,766,638 | B2 | 9/2017 | Georgin |
| 9,981,529 | B2 | 5/2018 | Waseen et al. |
| 10,112,727 | B1 | 10/2018 | Cutler |
| 2004/0030531 | A1 | 2/2004 | Miller et al. |
| 2006/0016201 | A1 | 1/2006 | Kopel |
| 2007/0118270 | A1 | 5/2007 | Wiseman et al. |
| 2010/0056039 | A1 | 3/2010 | Weber et al. |
| 2010/0123421 | A1 | 5/2010 | Grabinger et al. |
| 2011/0076131 | A1 | 3/2011 | Stabley et al. |
| 2014/0277764 | A1 | 9/2014 | Burt |
| 2015/0323928 | A1 | 11/2015 | Vim et al. |
| 2016/0049576 | A1 | 2/2016 | Levatich et al. |
| 2017/0152862 | A1 | 6/2017 | Houst et al. |
| 2017/0293293 | A1 | 10/2017 | Brownie et al. |

FIRE AND SMOKE ACTUATOR WITH TEMPERATURE-DEPENDENT OPERATING SPEED

TECHNICAL FIELD

The present disclosure pertains generally to fire and smoke systems, and more particularly to fire and smoke systems using fire and smoke actuators that actuate dampers within supply and return air ducts of the fire and smoke system.

BACKGROUND

Fire and smoke systems are often used to regulate air flow within a building in the event of a fire and/or smoke event. In some cases, there may be a desire to provide fresh air from outside of the building in order to clear smoke from an interior of the building. In some cases, there may be a desire to reduce the flow of air into the building in order to starve a fire of oxygen. A fire and smoke system includes supply air ducts that bring fresh air directly into the building from outside of the building. A fire and smoke system also includes return air ducts that vent air from inside the building directly to the exterior of the building. These supply and return air ducts may be part of a Heating, Ventilation and Air Conditioning (HVAC) system, or may be separate from the HVAC system. The supply and return air ducts of the fire and smoke system include dampers within the air ducts in order to control relative air flow through the air ducts. The dampers can be actuated between a closed position in which air flow through a particular air duct is restricted and an open position in which air flow through the particular duct is not restricted or is less restricted. Dampers are driven between the closed position and the open position via actuators that employ a motor to drive an output that engages a damper shaft in order to move the damper in response to a control signal. Improvements in the hardware, user experience, and functionality of fire and smoke actuators, particularly at elevated operating temperatures, would be desirable.

SUMMARY

The disclosure is directed to fire and smoke actuators that are configured to adjust their operating speed in accordance with ambient temperatures. For example, at lower temperatures, such as may be experienced during the manufacturing process, and perhaps during installation, the fire and smoke actuators may operate at a relatively higher speed. At higher temperatures, such as may be experienced during a fire or smoke event. the fire and smoke actuators may operate at a relatively lower speed in order to protect the integrity of polymeric components within the actuator.

In a particular example of the disclosure, a fire and smoke actuator is configured to actuate a damper between an open position and a closed position. The fire and smoke actuator includes a temperature sensor for sensing an operating temperature of the fire and smoke actuator, a drive motor, an actuator output for coupling to the damper to move the damper between the open position and the closed position and a drivetrain that is operably coupled between the drive motor and the actuator output. When the drive motor is activated, the drive motor is to actuate the actuator output, via the drivetrain, to move the damper between the open position and the closed position. A drive circuit is operably coupled to the drive motor and the temperature sensor and is configured to activate the drive motor to move the damper between the open position and the closed position at a non-zero speed, wherein the non-zero speed is based, at least in part, on the operating temperature sensed by the temperature sensor.

In another example of the disclosure, a fire and smoke actuator that is configured to actuate a damper includes a motorized actuator for actuating the damper between a fully open position and a fully closed position, a temperature sensor and a controller that is operatively coupled to the motorized actuator and the temperature sensor. The controller is configured to operate the motorized actuator to move the damper between the fully open position and the fully closed position in less than 40 seconds when the temperature sensor indicates an operating temperature below a first temperature threshold and to operate the motorized actuator to move the damper between the fully open position and the fully closed position in a range of 50 to 75 seconds, as specified by regulatory standards, when the temperature sensor indicates an operating temperature above a second temperature threshold, wherein the first temperature threshold is less than or equal to the second temperature threshold.

In another example of the disclosure, a method of operating a fire and smoke actuator that is configured to actuate a damper includes measuring a temperature proximate the fire and smoke actuator. When the measured temperature is below a first temperature threshold, a drive motor of the fire and smoke actuator is operated at a first operating speed in order to open or close the damper. When the measured temperature is at or above a second temperature threshold, the drive motor of the fire and smoke actuator is operated at a second operating speed in order to open or close the damper, the second operating speed being less than the first operating speed.

The above summary of some embodiments is not intended to describe each disclosed embodiment or every implementation of the present disclosure. The Figures, and Detailed Description, which follow, more particularly exemplify some of these embodiments.

BRIEF DESCRIPTION OF THE DRAWINGS

The disclosure may be more completely understood in consideration of the following description of various illustrative embodiments of the disclosure in connection with the accompanying drawings, in which.

Figure 1:
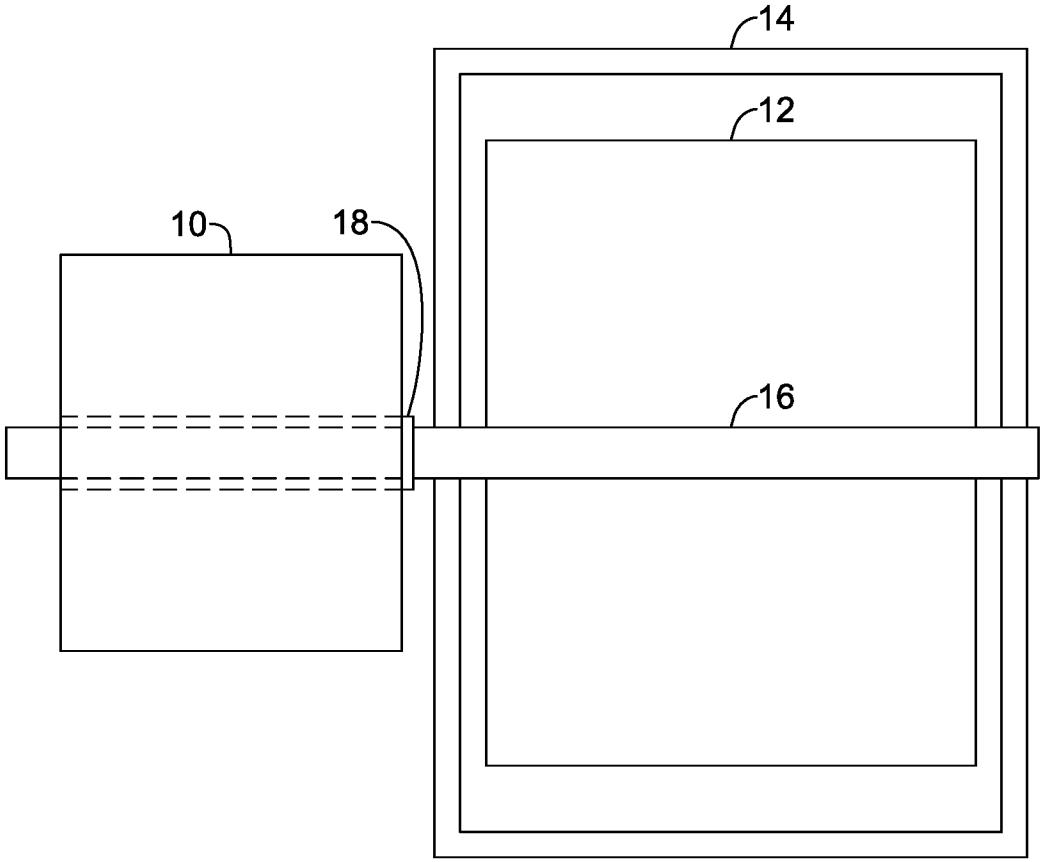
FIG. 1 is a schematic view of an illustrative fire and smoke actuator coupled with a damper shown in a closed position.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

Figure 2:
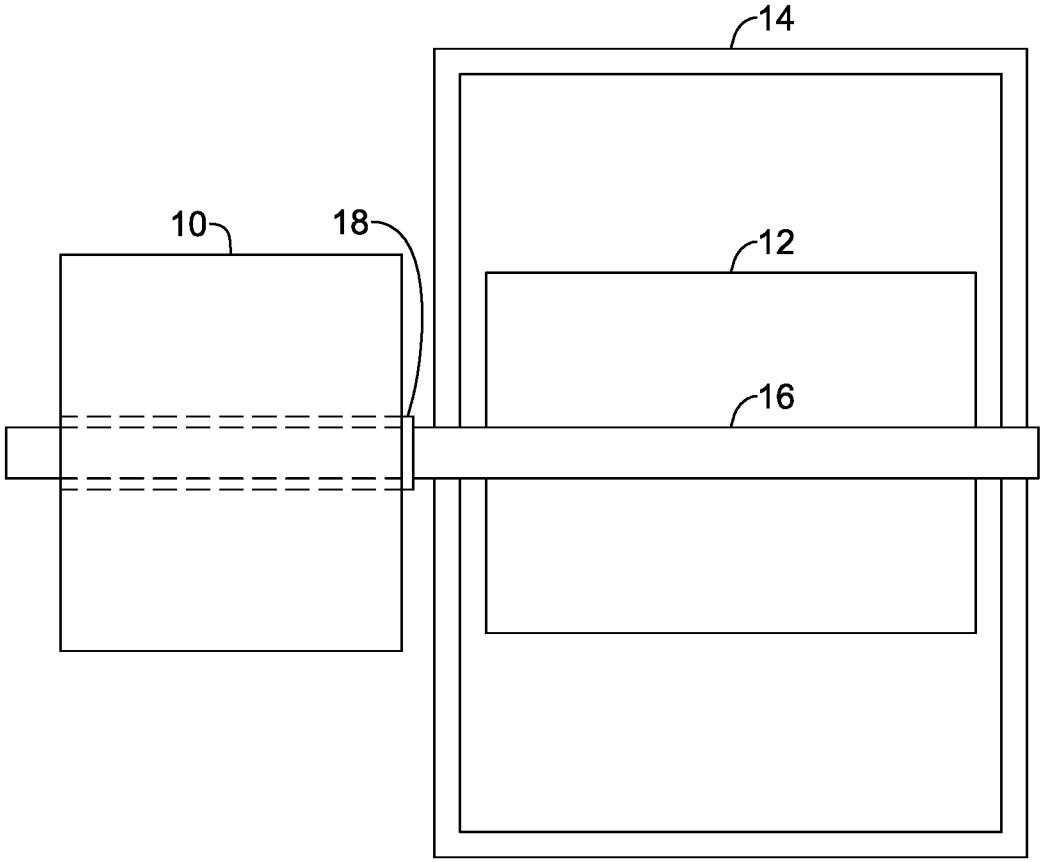
FIG. 2 is a schematic view of an illustrative fire and smoke actuator coupled with a damper shown in an open position.

FIG. 1 is a schematic side view of a fire and smoke actuator 10 that is coupled with a damper 12 that is shown in a closed position while FIG. 2 schematically shows the damper 12 in an open position. The damper 12 is shown disposed within a duct 14. The duct 14 may represent a fire and smoke air supply duct bringing fresh air into a building or a fire and smoke air return duct that exhausts stale air, smoke and the like to an exterior of the building. In some cases, one or more of a building's HVAC system ducts may be used as a supply duct and/or as a return duct. In some instances, the ducts forming a fire and smoke ventilation system for the building may be distinct from the ducts forming the HVAC system. A fire and smoke system controller (not illustrated) may send commands to the fire and smoke actuator 10 to either open or close the damper 12, depending on the current situation within the building and what is needed.

As can be seen, the damper 12 includes a rotatable or otherwise movable obstruction such as a damper blade within the duct 14 that can be actuated between a closed position, as shown in FIG. 1, and an open position, as shown in FIG. 2. In an open position there is relatively little resistance to air flow within the duct while in the closed position, there is relatively greater resistance to air flow. It will be appreciated that the damper 12 is coupled to a damper shaft 16 such that rotation of the damper shaft 16 causes a corresponding rotation of the damper 12. The damper shaft 16 can be actuated, i.e., caused to rotate, by any of a number of electrical, pneumatic or mechanical actuators. The fire and smoke actuator 10 includes an actuator output 18 that is configured to rotatably engage the damper shaft 16. In some cases, the actuator output 18 is configured such that the damper shaft 16 extends through the actuator output 18, but this is not required in all cases. The fire and smoke actuator 10 includes a motor (not visible in FIGS. 1 and 2) that is configured to rotate the actuator output 18 and thus the damper shaft 16.

It will be appreciated that in some cases, the fire and smoke actuator 10 may be exposed to temperatures that can reach levels well above normal ambient temperatures in the event that there is a fire nearby. In some cases, the fire and smoke actuator 10 may be configured to monitor the temperature in or near the fire and smoke actuator 10, and may alter its operating speed accordingly. For example, the fire and smoke actuator 10 may operate at a first speed when at a relatively low temperature, such as below 100 degrees Fahrenheit (F), and may slow to a second speed that is less than the first speed when the temperature exceeds 100 degrees F., or 120 degrees F. These are just examples. In some cases, internal components of the fire and smoke actuator 10 may be sensitive to higher temperatures, and thus may be more susceptible to damage at higher temperatures. By slowing the fire and smoke actuator 10 at elevated temperatures, there may be less chance of damage if the damper 12 strikes an obstacle, for example, or reaches an end stop.

Figure 3:
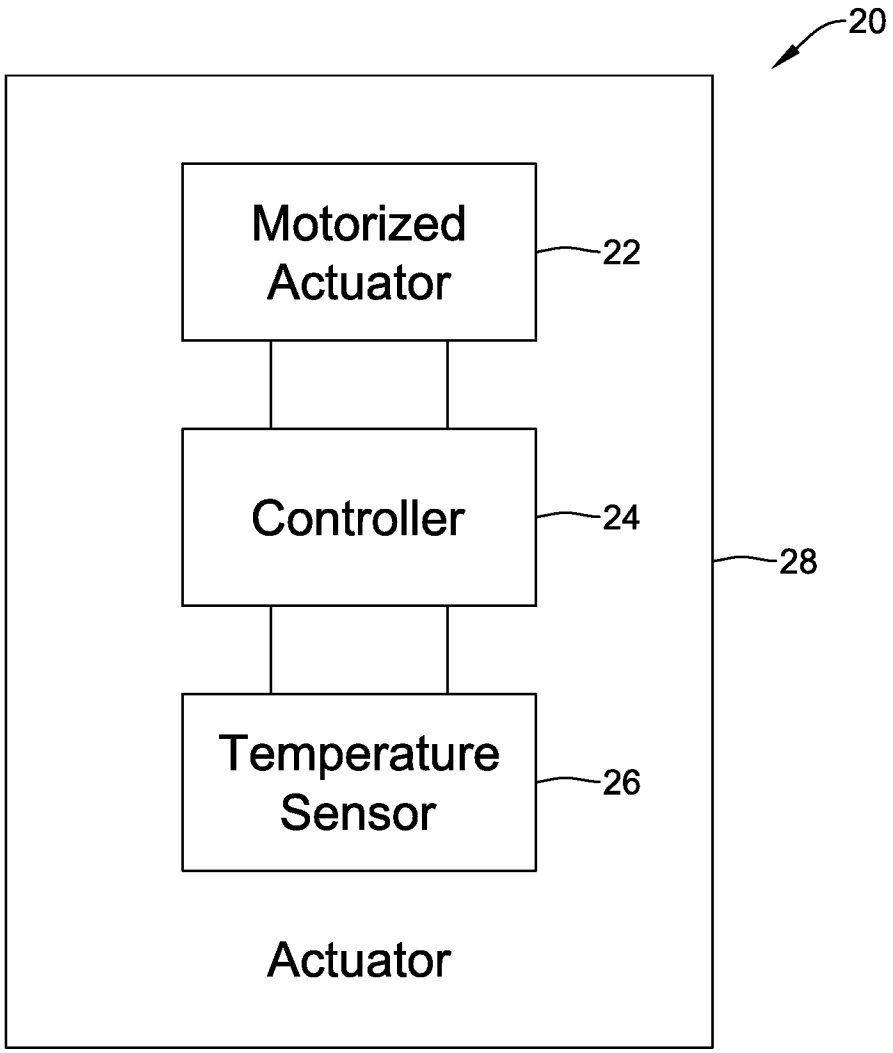
FIG. 3 is a schematic block diagram of an illustrative fire and smoke actuator.

FIG. 3 is a schematic block diagram of an illustrative fire and smoke actuator 20 that is configured to actuate a damper. In some cases, the fire and smoke actuator 20 may be considered as being an example of the fire and smoke actuator 10 shown in FIGS. 1 and 2. The fire and smoke actuator 20 includes a motorized actuator 22 for actuating the damper 12 between a fully open position and a fully closed position. A temperature sensor 24 may be mounted on or within the fire and smoke actuator 20, and provides a signal representative of temperature to a controller 26. The controller 26 is operably coupled to both the motorized actuator 22 and the temperature sensor 24. In some cases, the fire and smoke actuator 20 includes a housing 28 that is configured to house the motorized actuator 22, the temperature sensor 24 and the controller 26.

The controller 26 may be configured to operate the motorized actuator 22 to move the damper 12 between the fully open position and the fully closed position in less than 40 seconds when the temperature sensor 24 indicates an operating temperature below a first temperature threshold and to operate the motorized actuator 22 to move the damper 12 between the fully open position and the fully closed position in a range of 50 to 75 seconds when the temperature sensor 24 indicates an operating temperature above a second temperature threshold, wherein the first temperature threshold is less than or equal to the second temperature threshold. In some cases, the first temperature threshold is the same as the second temperature threshold. For example, the second temperature threshold may be greater than about 120 degrees F. The second temperature threshold may be about 150 degrees F.

Figure 4:
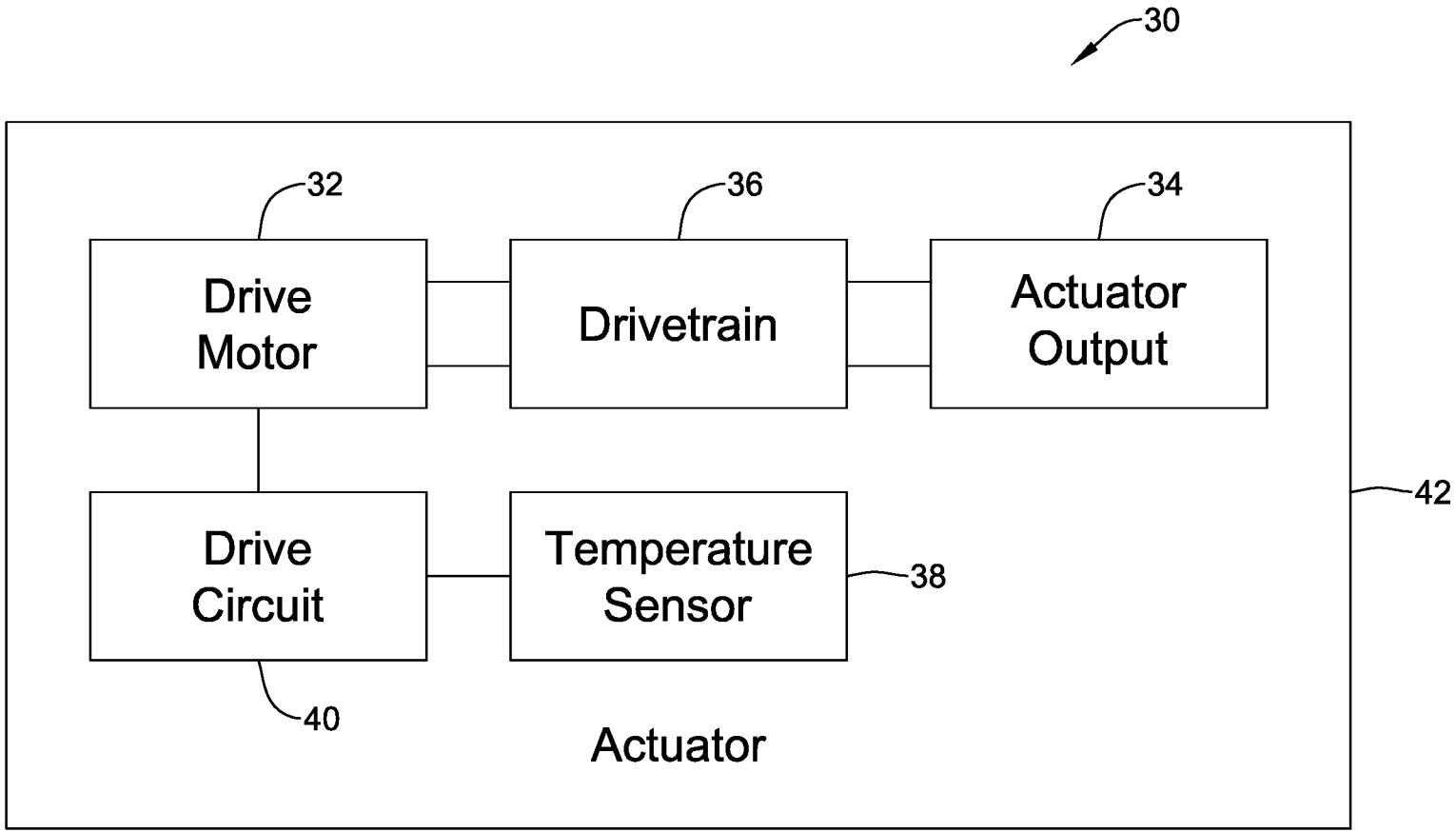
FIG. 4 is a schematic block diagram of an illustrative fire and smoke actuator.

FIG. 4 is a schematic block diagram of an illustrative fire and smoke actuator 30 that is configured to actuator the damper 12 between an open position and a closed position. The fire and smoke actuator 30 includes a drive motor 32, an actuator output 34 for coupling to the damper 12 in order to move the damper 12 between the open position and the closed position, and a drivetrain 36 that is operably coupled between the drive motor 32 and the actuator output 34. The drive motor 32 may be configured, when actuated, to actuate the actuator output 34 via the drivetrain 36 to move the damper 12 between the open position and the closed position. A temperature sensor 38 is configured to sense an operating temperature of the fire and smoke actuator 20. A drive circuit 40 may be operably coupled to the drive motor 32 and to the temperature sensor 38, and may be configured to activate the drive motor 32 to move the damper 12 between the open position and the closed position at a non-zero speed, wherein the non-zero speed is based, at least in part, on the operating temperature sensed by the temperature sensor 38. A housing 42 may house one or more of the drive motor 32, the actuator output 34, the drivetrain 36, the temperature sensor 38 and the drive circuit 40.

It will be appreciated that the drivetrain 36 is configured to translate rotation of an output shaft of the drive motor 32 into rotation of the actuator output 34. The drivetrain 36 may include one or more gears that are disposed between the drive motor 32 and the actuator output 34. In some cases, the drivetrain 36 may include one or more components, such as but not limited to these gears, that are more susceptible to wear and/or damage at a higher operating temperature than at a lower operating temperature, and thus the drive circuit 40 may set the non-zero speed lower at the higher operating temperature than at the lower operating temperature. In some cases, the damper 12 may have an end stop, and the drive circuit 40 may be configured to reduce the non-zero speed at the higher operating temperature relative to the non-zero speed at the lower operating temperature when the end stop is reached to help protect the one or more components of the drivetrain 36 that are more susceptible to wear and/or damage at the higher operating temperature when the end stop is reached.

In some cases, the non-zero speed may be a linear function of the operating temperature between an upper speed limit and a lower speed limit, meaning that the non-zero speed changes continuously with temperature. The non-zero speed may, for example, be a non-linear function of the operating temperature between an upper speed limit and a lower speed limit. The non-zero speed may be a step-wise function of the operating temperature between an upper speed limit and a lower speed limit. In some cases, the non-zero speed may be set to a first non-zero speed when the operating temperature is above a temperature threshold and is set to a second non-zero speed when the operating temperature is below the temperature threshold. The temperature threshold may, for example, be greater than about 120 degrees F., or about 150 degrees F.

Figure 5:
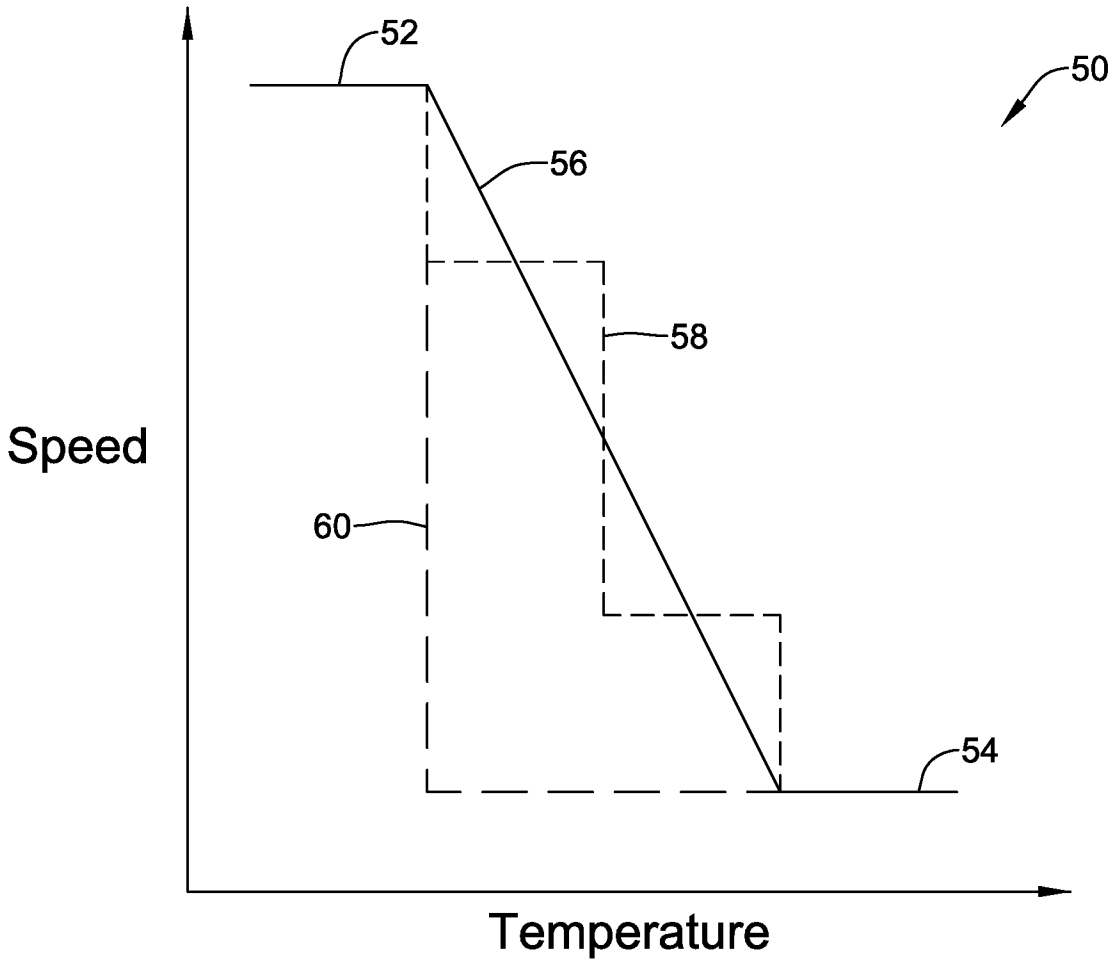
FIG. 5 is a graph providing an example of how the illustrative fire and smoke actuators of FIGS. 1 through 4 may vary their speed relative to ambient temperature.

FIG. 5 provides a graphical representation 50 of how the non-zero speed may be related to temperature. Speed is graphed along the Y, or vertical, axis, and temperature is graphed along the X, or horizontal, axis. At relatively low temperatures, the speed may be equal to an upper speed limit, denoted as 52. At high temperatures, the speed may be equal to a lower speed limit, denoted as 54. If there is a linear relationship between temperature and speed, line 56 indicates what the speed may be that corresponds to any particular temperature that is between the upper speed limit and the lower speed limit. This may be considered as being a continuously changing speed as the measured temperature changes. A dashed line 58 provides an example of a stepwise relationship between temperature and speed. In some cases, there may be a simple binary relationship between temperature and speed as indicated by the dotted line 60. The speed remains at the upper speed limit until a particular temperature is reached, at which point the speed drops directly to the lower speed limit. These are just examples, as other relationships between temperature and speed are contemplated.

Figure 6:
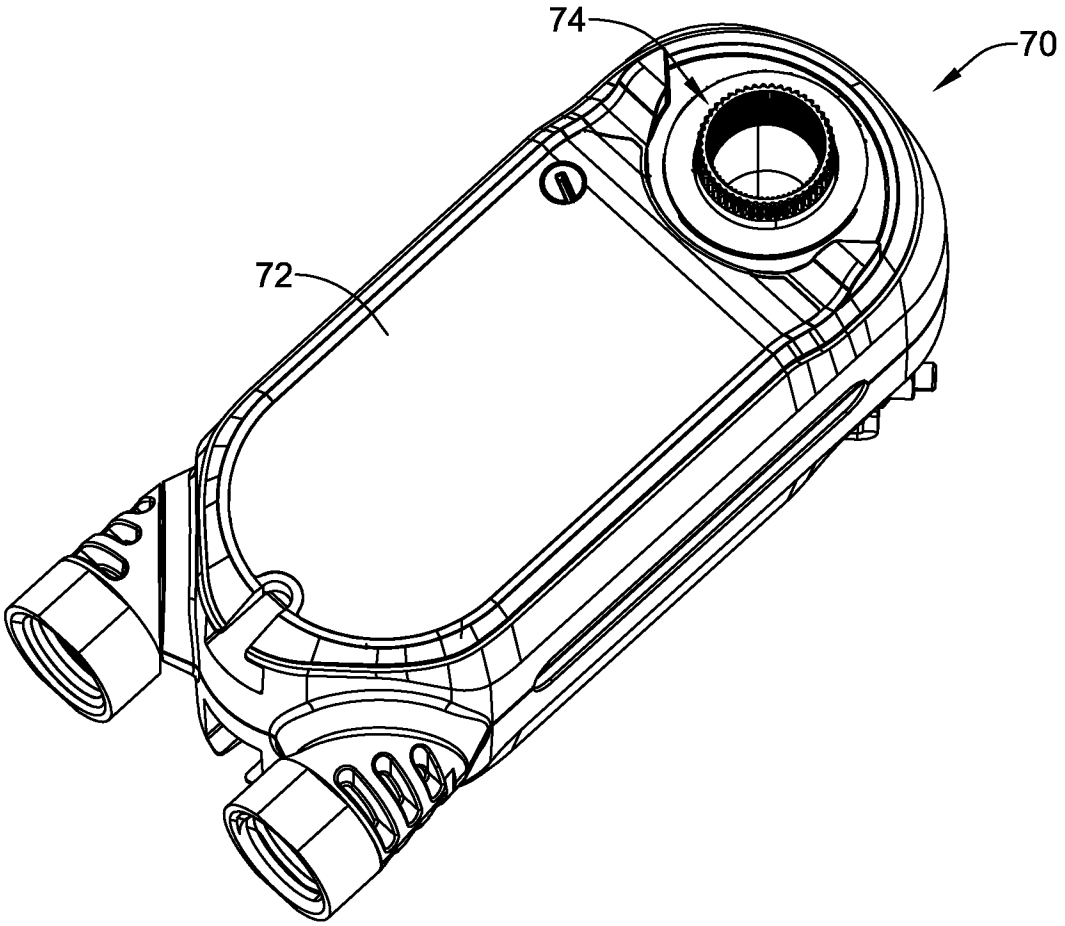
FIG. 6 is a perspective view of an illustrative fire and smoke actuator.
Figure 7:
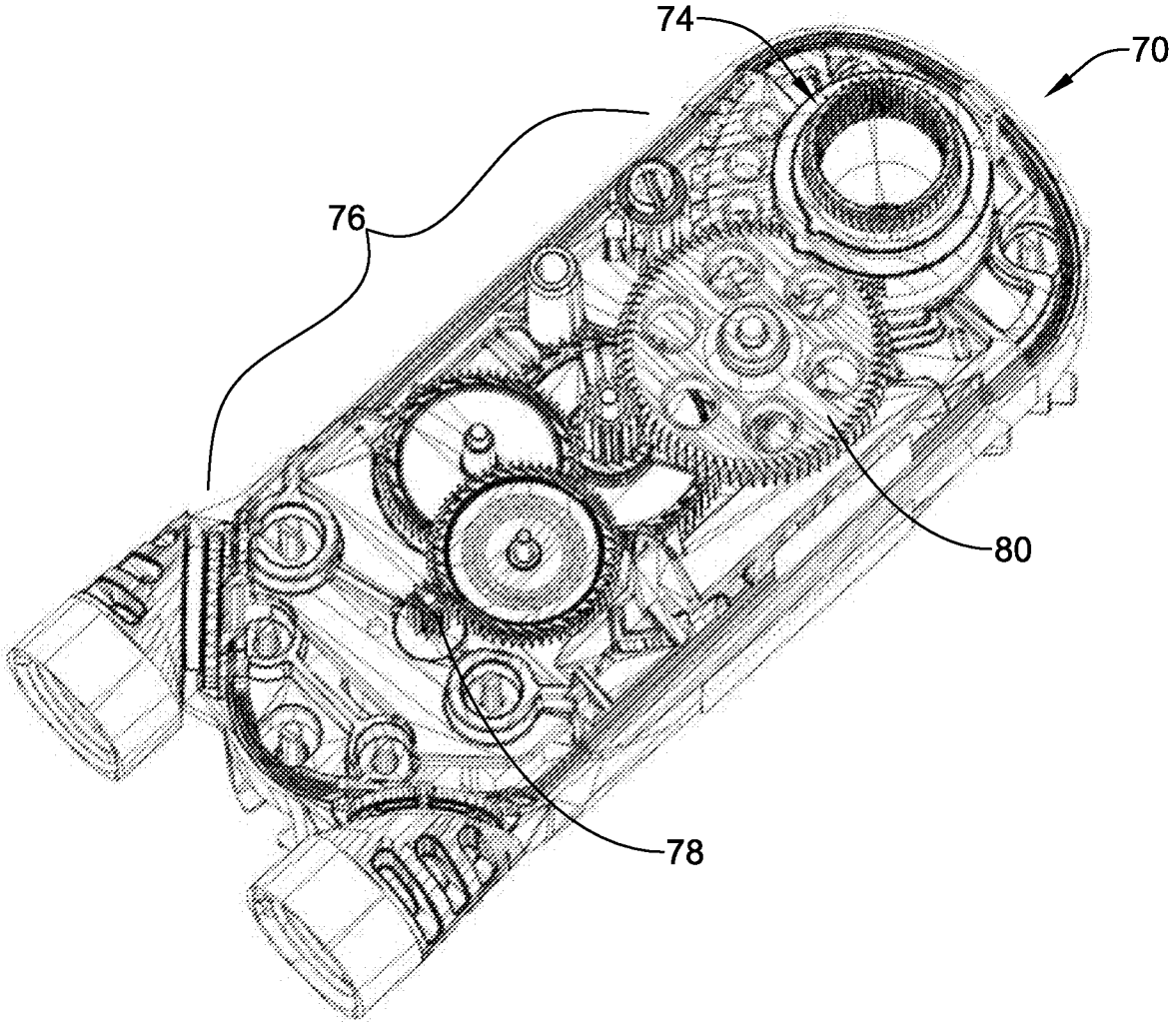
FIG. 7 is a partial cutaway view of the illustrative fire and smoke actuator of FIGS. 6.

FIG. 6 is a perspective view of a fire and smoke actuator 70 that includes a housing 72. FIG. 7 is a perspective view of the fire and smoke actuator 70 with at least a portion of the housing 72 removed in order to illustrate internal components. The fire and smoke actuator 70 includes an actuator output 74. The fire and smoke actuator 70 includes a gear train 76 including an input gear 78 that is driven by the drive motor (such as the drive motor 32 in FIG. 4) and an output gear 80 that drives the actuator output 74. In some cases, the output gear 80 includes polymeric gear teeth, and/or the entire output gear 80 may be polymeric. In some cases, the input gear 78 includes polymeric gear teeth, and/or the entire input gear 78 may be polymeric. One or more of the gears within the gear train 76 may also be metallic.

In some cases, the gear train 76 has an overall gear ration that is greater than about 1000:1. This means that for each rotation of the output gear 80, the input gear rotates at least about 1000 complete revolutions. In some cases, the gear train 76 has a gear ratio of greater than about 2500:1, or even a gear ration of greater than about 5000:1. It will be appreciated that the particular gear ratio may be selected in accordance with the performance characteristics of the drive motor as well as the operational limitations of the damper 12 (how far the damper 12 can rotate, and a size and/or weight of the damper 12).

Figure 8:
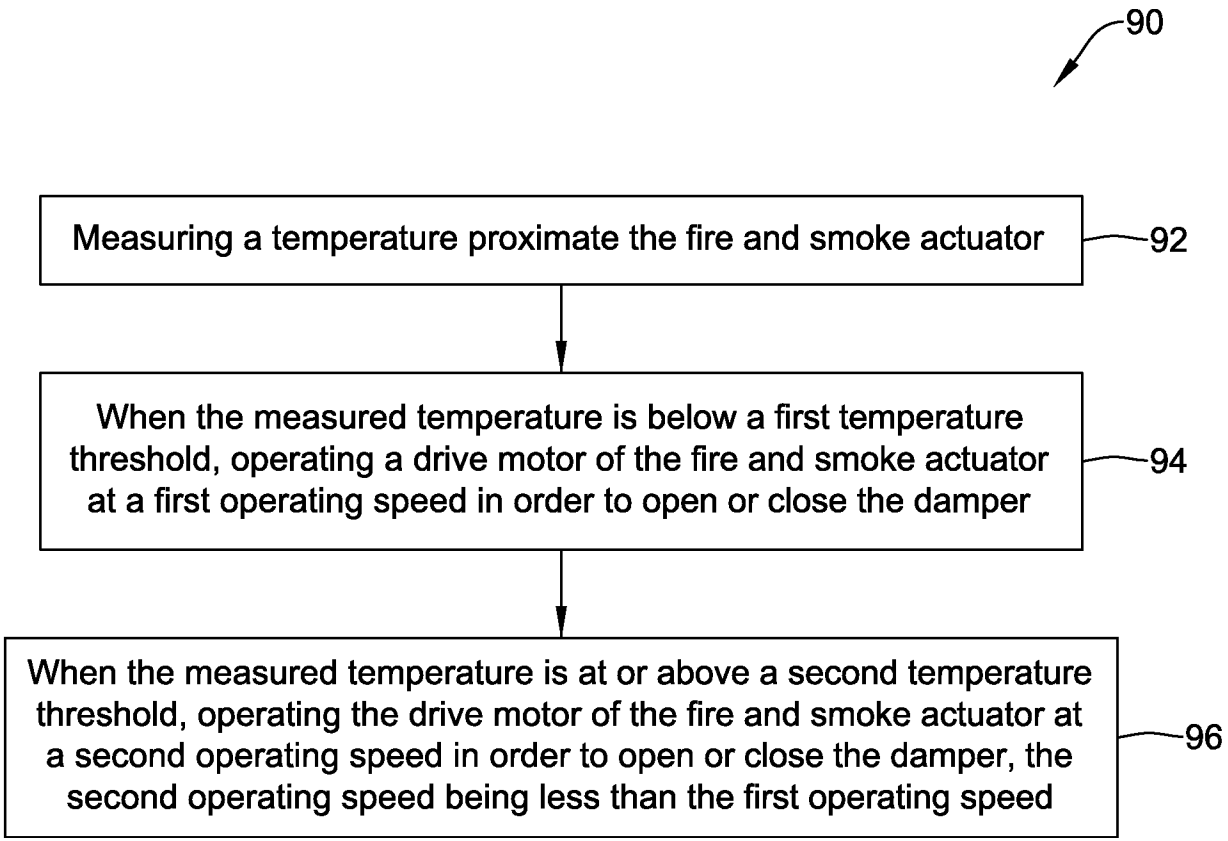
FIG. 8 is a flow diagram showing an illustrative method of operating a fire and smoke actuator.

FIG. 8 is a flow diagram showing an illustrative method 90 of operating a fire and smoke actuator that is configured to actuate a damper. The method 90 includes measuring a temperature proximate the fire and smoke actuator, as indicated at block 92. When the measured temperature is below a first temperature threshold, the drive motor of the fire and smoke actuator may be operated at a first operating speed in order to open or close the damper, as indicated at block 94. When the measured temperature is at or above a second temperature threshold, the drive motor of the fire and smoke actuator may be operated at a second operating speed in order to open or close the damper, the second operating speed being less than the first operating speed as indicated at block 96. In some cases, the first temperature threshold is the same as the second temperature threshold.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example embodiment being used in other embodiments. The invention's scope is, of course, defined in the language in which the appended claims are expressed.

What is claimed is:

1. A fire and smoke actuator configured to actuate a damper between an open position and a closed position, the fire and smoke actuator comprising:

a drive motor;

an actuator output for coupling to the damper to move the damper between the open position and the closed position;

a drivetrain operably coupled between the drive motor and the actuator output, wherein the drive train includes one or more components that are more susceptible to wear and/or damage at an operating temperature of the drivetrain that is elevated by an external heat source;

wherein the drive motor, when activated, is configured to actuate the actuator output, via the drivetrain, to move the damper between the open position and the closed position;

a temperature sensor configured to detect a temperature representative of the operating temperature of the drivetrain of the fire and smoke actuator; and a drive circuit operably coupled to the drive motor and the temperature sensor, the drive circuit configured to activate the drive motor to move the damper between the open position and the closed position at a non-zero speed, wherein the non-zero speed is lower when the temperature sensor detects that the operating temperature of the drivetrain is elevated by the external heat source than when the temperature sensor detects that the operating temperature of the drivetrain is not elevated by the external heat source.

2. The fire and smoke actuator of claim 1, wherein the external heat source is a fire.

3. The fire and smoke actuator of claim 1, wherein the one or more components of the drivetrain comprises a gear train that includes an input gear driven by the drive motor and an output gear that drives the actuator output, wherein the output gear comprises polymeric gear teeth.

4. The fire and smoke actuator of claim 3, wherein the gear train has a gear ratio of greater than 1000:1.

5. The fire and smoke actuator of claim 3, wherein the gear train has a gear ratio of greater than 2500:1.

6. The fire and smoke actuator of claim 3, wherein the gear train has a gear ratio of greater than 5000:1.

7. The fire and smoke actuator of claim 2, wherein the one or more components of the drivetrain comprises a gear train that includes an input gear driven by the drive motor and an output gear that drives the actuator output, wherein the input gear comprises polymeric gear teeth.

8. The fire and smoke actuator of claim 2, wherein the damper has an end stop, and wherein the drive circuit drives the drive motor to move the damper toward the closed position at the non-zero speed, and then reducing the non-zero speed to a lower non-zero speed before engaging the end stop to help protect the one or more components of the drivetrain that are more susceptible to wear and/or damage at the operating temperature elevated by the fire when the end stop is reached.

9. The fire and smoke actuator of claim 1, wherein the non-zero speed is a linear function of the operating temperature between an upper speed limit and a lower speed limit.

10. The fire and smoke actuator of claim 1, wherein the non-zero speed is a non-linear function of the operating temperature between an upper speed limit and a lower speed limit.

11. The fire and smoke actuator of claim 1, wherein the non-zero speed is a step-wise function of the operating temperature between an upper speed limit and a lower speed limit.

12. The fire and smoke actuator of claim 1, wherein the non-zero speed is set to a first non-zero speed when the operating temperature is above a temperature threshold and is set to a second lower non-zero speed when the operating temperature is below the temperature threshold.

13. The fire and smoke actuator of claim 12, wherein temperature threshold is greater than 120 degrees Fahrenheit (F).

* * * * *